US009444203B2

(12) United States Patent
Zhong et al.

(10) Patent No.: US 9,444,203 B2
(45) Date of Patent: Sep. 13, 2016

(54) ELECTRIC CONNECTOR ASSEMBLY WITH A RELIABLE LOCKING DEVICE

(71) Applicant: FOXCONN INTERCONNECT TECHNOLOGY LIMITED, Grand Cayman (KY)

(72) Inventors: Wei Zhong, Kunshan (CN); Jian-Kuang Zhu, Kunshan (CN); Chun-Sheng Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/855,317

(22) Filed: Sep. 15, 2015

(65) Prior Publication Data

US 2016/0079720 A1 Mar. 17, 2016

(30) Foreign Application Priority Data

Sep. 15, 2014 (CN) ..... 2014 1 0467512

(51) Int. Cl.

*H01R 24/00* (2011.01)
*H01R 24/66* (2011.01)
*H01R 24/76* (2011.01)
*H01R 107/00* (2006.01)

(52) U.S. Cl.

CPC ..... *H01R 24/66* (2013.01); *H01R 24/76* (2013.01); *H01R 2107/00* (2013.01)

(58) Field of Classification Search

CPC ..... H01R 24/00; H01R 24/66; H01R 24/76; H01R 12/774; H01R 12/775; H01R 12/778; H01R 13/20

USPC ..... 439/660, 676, 851, 852, 607.04, 439/607.07, 607.09, 607.11–607.13, 439/607.31, 607.32, 607.35, 607.36, 439/607.38, 607.4, 607.44, 620.06, 620.11, 439/620.12, 620.15, 620.16, 620.19

See application file for complete search history.

(56) References Cited

U.S. PATENT DOCUMENTS

| | | | | |
|---|---|---|---|---|
| 7,134,900 | B2 * | 11/2006 | Chung | H01R 13/6275 439/353 |
| 2006/0148300 | A1 * | 7/2006 | Huang | H01R 13/6275 439/353 |
| 2007/0243764 | A1 * | 10/2007 | Liu | H01R 13/6581 439/607.01 |
| 2008/0132116 | A1 * | 6/2008 | Wu | H01R 27/00 439/607.17 |
| 2012/0282811 | A1 * | 11/2012 | Lin | H01R 43/20 439/626 |

FOREIGN PATENT DOCUMENTS

| | | |
|---|---|---|
| TW | M463457 U | 10/2013 |
| TW | M471049 U | 1/2014 |

* cited by examiner

*Primary Examiner* — Abdullah Riyami
*Assistant Examiner* — Harshad Patel
(74) *Attorney, Agent, or Firm* — Wei Te Chung; Ming Chieh Chang

(57) ABSTRACT

An electric connector assembly includes a plug connector and a mating socket connector, and the plug connector includes a base, a tongue plate protruding forwardly from the base and a plurality of electrical contacts. The tongue plate defines two relative surfaces and the tongue plate includes a terminal holder and a side portion beside the terminal holder in a transverse direction. The side portions define at least a pair of clamping portions recessed from the surface of the tongue plate, and the socket connector defines at least a pair of elastic arms for engaging with said clamping portions for enhancing the stability when the electric connector inserted into a mating connector.

16 Claims, 5 Drawing Sheets

ELECTRIC CONNECTOR ASSEMBLY WITH A RELIABLE LOCKING DEVICE

BACKGROUND OF THE INVENTION

1. Field of the Invention

The present invention relates to an electrical connector assembly, and particularly to an electrical connector assembly with a reliable locking device.

2. Description of Related Art

TW Patent No. M471049U, published on Jan. 20, 2014, discloses an electrical connector with a tongue plate. The tongue plate includes an assembly of a set of first terminals and a set of second terminals, and a shielding shell fixing the assembly. Both side walls of the tongue plate define a notch respectively. The notches could mate with a mating connector for protecting the electrical connector from falling off from the mating electrical connector.

However, while the tongue plate becomes miniature and flattening, the notches in the side walls of the tongue plate could not afford enough interference surface for retaining the tongue plate. It reduces the stability of the assembly of the electrical connector and a mating connector.

Hence, an improved electrical connector is required to overcome the disadvantages of the related art.

SUMMARY OF THE INVENTION

Accordingly, the object of the present invention is to provide an electrical connector assembly with a reliable locking device.

In order to achieve the object reminded above, a plug connector and a socket connector is provided. The plug connector includes a base, a mating tongue plate being panel-liked and protruding forwardly from the base, and the mating tongue plate defining two opposite surface in an up and down direction and including at least a contact carrier and two side portions at two lateral sides of the contact carrier in a cross direction perpendicular to said up and down direction; and a plurality of contacts including contact portions exposed onto the two contact carriers. Each of the side portions defines at least a clamping portion recessed from the surface of the mating tongue plate. And the socket connector includes an insulative housing with a cavity for receiving the said mating tongue plate; a metal shell covering the insulative housing; and a plurality of second contacts retained in the insulative housing. The metal shell defines two pairs of elastic arms at opposite thereof and protruding into the cavity to latch into the respective clamping portions of the mating tongue plate.

What is different, the clamping portion is defined in the upper and lower surface of the mating tongue plate, not only changes the number of the clamping portions from one pair to two pair for a better retaining force, but also when the mating tongue plate becomes miniature and flattening, it could guarantee an enough interference area between the metal elastic arm and the clamping portion to keep the stability between two mated plug connector and socket connector. On the other hand, the interference points of the second contacts of the socket connector with the mating tongue and another set of the interference points of the metal elastic arms with the mating tongue is nonlinear, and which would reduce the inserting force for a more convenience using.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
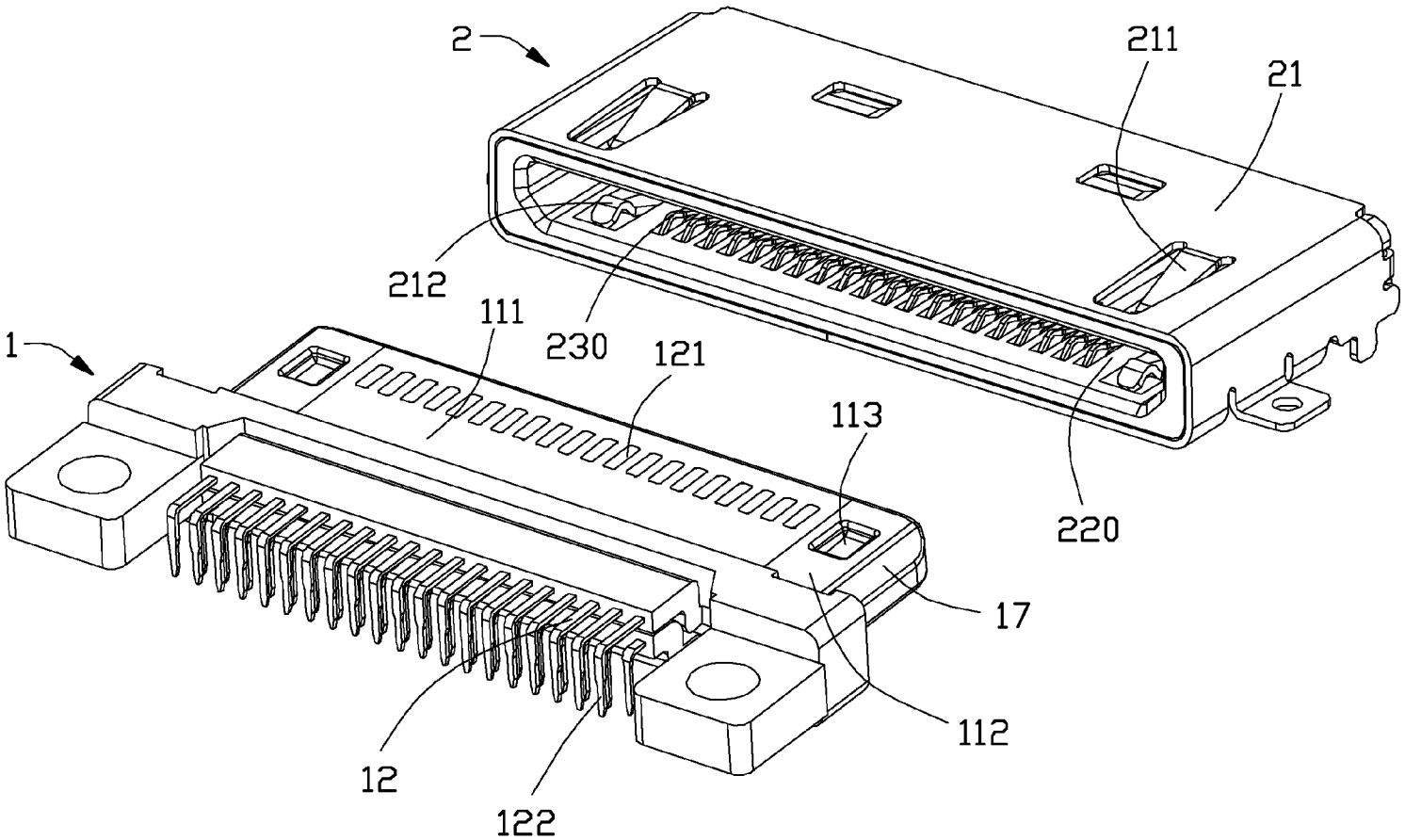
FIG. 1 is a perspective view of an electrical connector assembly in accordance with the present invention.

Referring to FIGS. 1, the electrical connector assembly according to the present invention includes a plug connector 1 and a socket connector 2. Which is need to be noticed, the electrical connector assembly could be set or mated in different station, such as in horizontal or perpendicular or inclined station, and the electrical connector assembly would be described in the horizontal station.

Figure 2:
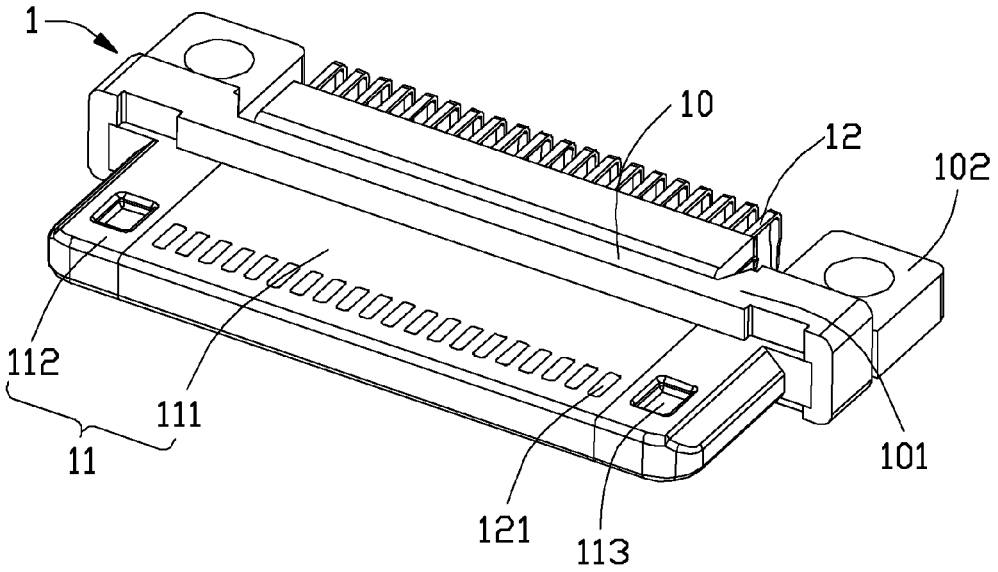
FIG. 2 is a perspective view of a plug connector of the electrical connector assembly shown in FIG. 1.

Referring to FIG. 1 and FIG. 2, the plug connector 1 includes a base 10, a mating tongue plate 11 extending forwardly from the base 10 and a plurality of contacts 12. The mating tongue plate 11 defines a pair of opposite surfaces, and the mating tongue plate 11 includes a pair of insulating contact carriers 111 and a pair of side portions 112 at two lateral sides of the contact carrier 111. The side portion 112 defines a pair of clamping portions 113 recessed from both side surfaces thereof. Each of the contacts 12 includes a contact portion 121 which are set in a row in the contact carrier 111 and a tail portion 122 extending out of the base 10.

According the present invention, the contact portion 121 of the contact 12 is block-shaped and defines a contacting face flush with the surface of the mating tongue plate 11. The plug connector 1 defines an inserting direction, and in the inserting direction, the clamping portion 113 locates behind the contact portion 121 of the contact 12.

The base 10 includes a vertical main portion 101 and a pair of fixing portions 102, and the tail portions 122 of the contacts 12 extend out of base 10 and are arranged between the pair of fixing portion 102.

Figure 3:
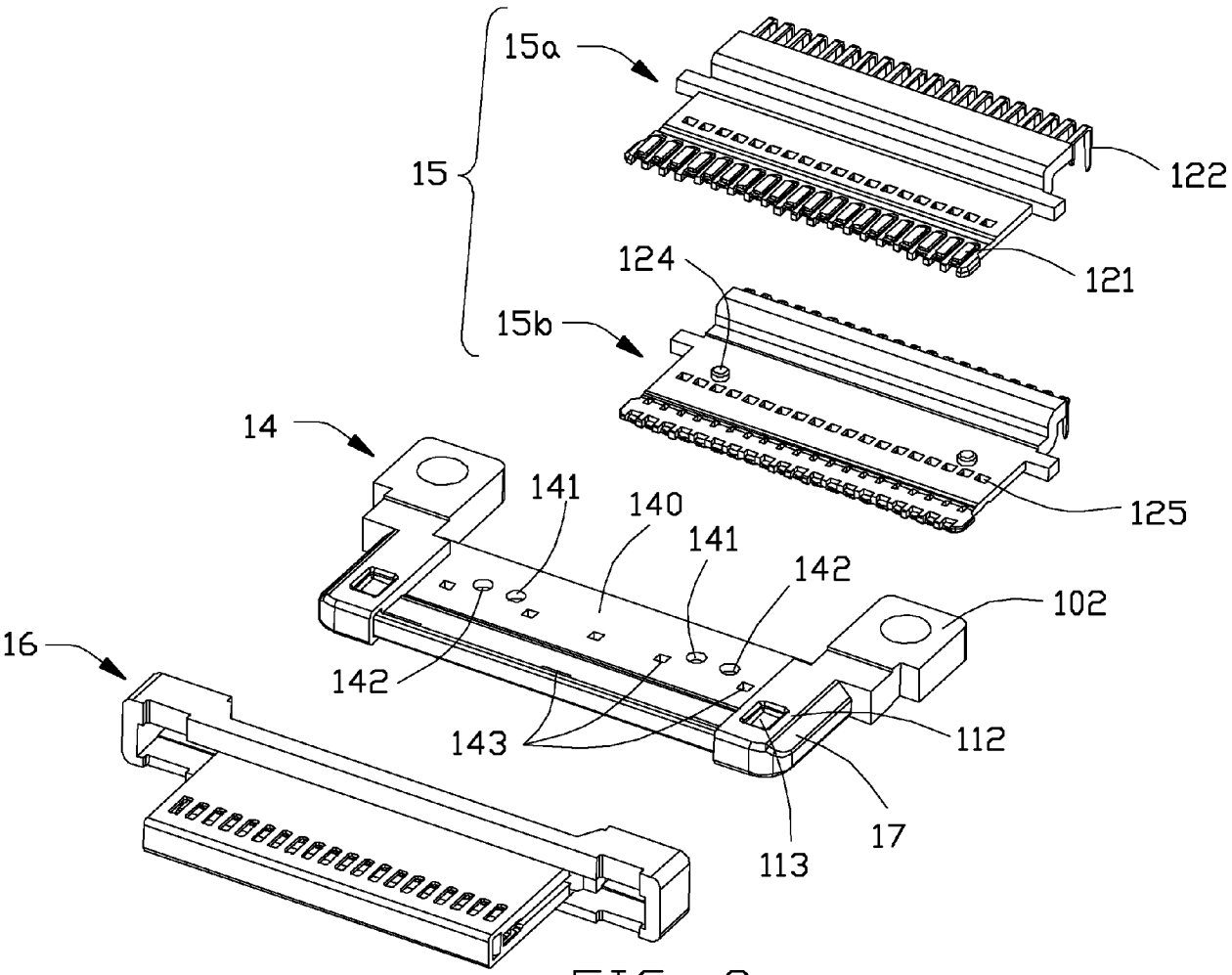
FIG. 3 is an exploded view of the plug connector shown in FIG. 2.
Figure 4:
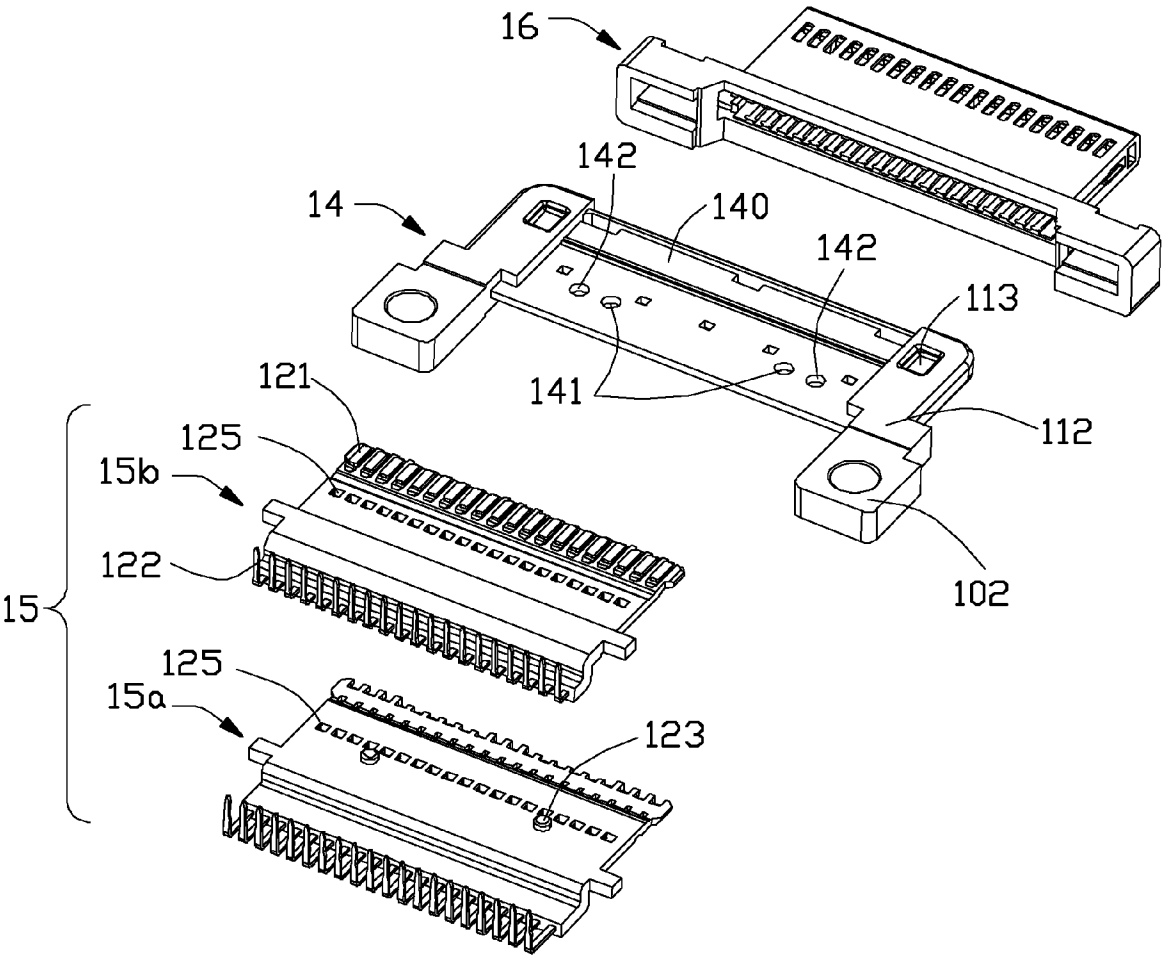
FIG. 4 is an exploded view in another angle of the plug connector shown in FIG. 2.

Referring to FIG. 3 and FIG. 4, an introduction of the structure of the plug connector 1 is made below. The plug connector 1 includes a metal frame 14, two contact assemblies 15 and an insulative housing 16 insert-molding between the contact assemblies 15 and the metal frame 14. The contacts 12 are arranged in two rows and received in the two contact assemblies 15 respectively. The metal frame 14 defines a upper and a lower surface, and includes a main portion 140, a pair of side portions 112 protrude from the upper and the lower surface at two lateral sides of the metal frame 14 in the cross direction, and two fixing portion 102 extending backwardly from the side portions 112 respectively. The main portion 140 and the insulative housing 16 make of the foregoing contact carrier 111.

The aforementioned two contact assemblies 15 could be divided into a first contact assembly 15*a* and a second contact assembly 15*b*, and each of the first and the second contact assembly 15*a*, 15*b* includes a row of block-shaped contact portions 121 in the cross direction. The contact portions are exposed onto the mating tongue plate 11 for an electrical communication with the aforementioned socket connector 2. Each of the contact assemblies 15*a*, 15*b* has at least a positioning pillar 123, 124 facing the metal frame 14 respectively. Furthermore, each of the contact assemblies defines several through holes 125 for sealant irrigation or injection molding between the contact assemblies and the metal frame 14.

According to present aspect of the invention, two receiving space is formed by the side portion 112 and the metal frame 14 for receiving the first and the second contact assembly respectively. The metal frame 14 defines several position holes 141, 142 corresponding with the aforesaid positioning pillars 123, 124 for mating the first and the second contact assembly and the metal frame as a whole. The metal frame 14 also defines a set of through slot 143, and when the whole of the contact assemblies and metal frame is been insert-molded, the plastic could pass through the through slot 143 and bond the contact assemblies 15 and the metal frame 14 closer.

The insulative housing 16 is formed out of the integrality of the contact assemblies 15 and the metal frame 14 by insert-molding. Particularly, the insulative housing 16 covers the front-end of the integrality for preventing direct short between the contacts of the plug connector 1 or the socket connector 2 when the plug connector 1 is being inserted into the socket connector 2.

Figure 5:
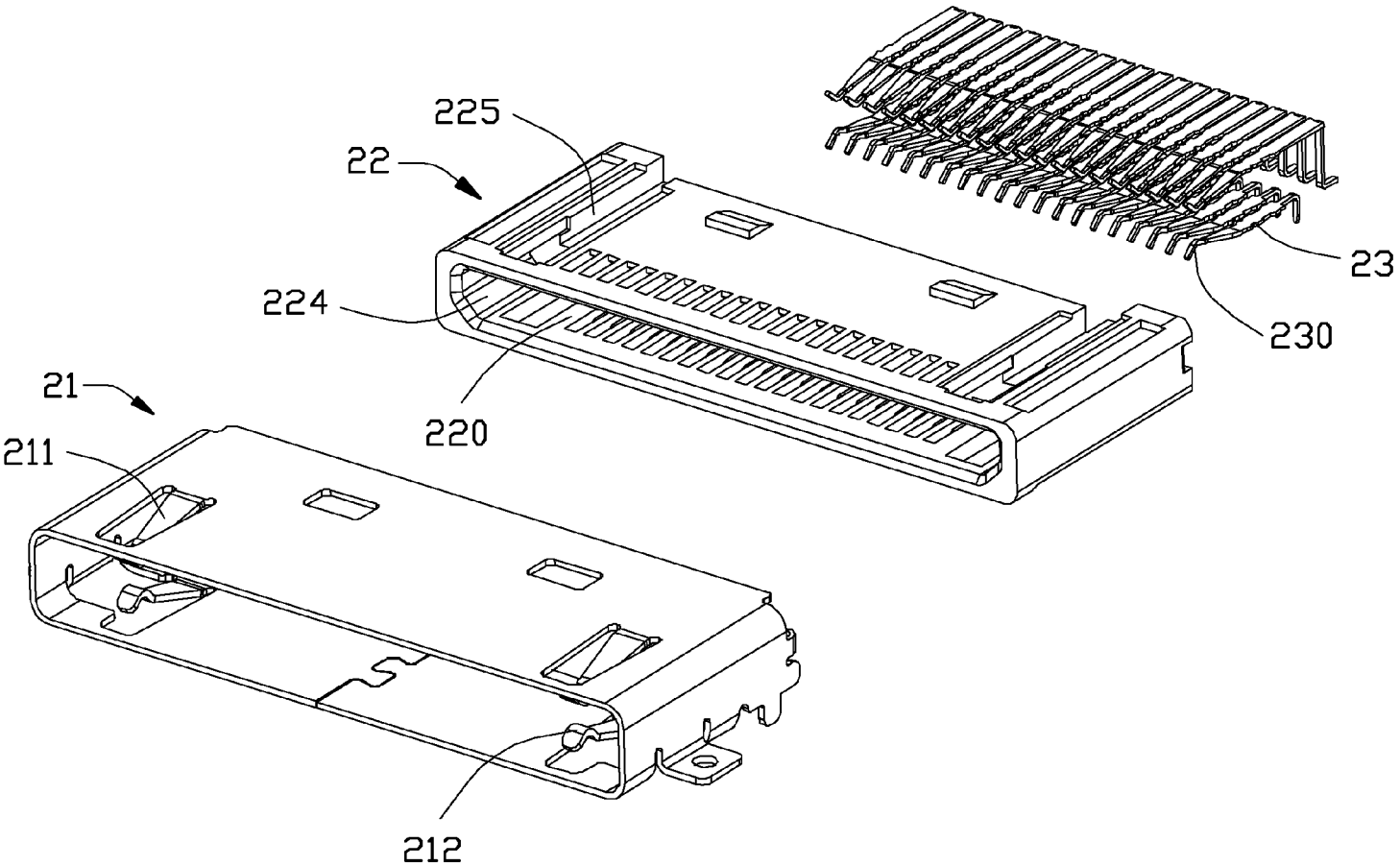
FIG. 5 is an exploded view of a socket connector of the electrical connector assembly shown in FIG. 1.

Referring to FIG. 5, an introduction of the structure of the socket connector 1 is made below. The socket connector 2 includes an insulative housing 22, a metal shell 21 mated out of the insulative housing 22 and a plurality of second contacts 23 retained in the insulative housing 22. The insulative housing 22 defines a (mating) cavity 220 for receiving the plug connector 1. The side portion 112 of mating tongue plate 11 of the plug connector 1 includes an upper surface, a lower surface parallel with the upper surface, a side surface vertical to the upper surface and a guiding incline 17 connecting the side surface and the lower surface, and corresponding to the side portion 112, the inner wall of the cavity 220 includes an upper wall, a lower wall parallel with the upper wall, two side walls vertical to the upper wall and at least a guarding incline wall 224 connecting the side wall and the lower wall. The guarding incline wall 224 is mated with the guarding incline surface 17 for avoiding any mis-mating.

The metal shell 21 defines several metal elastic arms 211 protruding into the cavity 220, and the insulative housing 22 also defines several channels or slots 225 for the metal elastic arms 211 to extend therethrough and further into the cavity 220 in the upper and lower wall. The channels 225 locate outside of the second contacts 23. Every the channel 225 extends backwardly and forms an opening backwardly for mating the metal elastic arms 211, and further, the channel 225 defines at least a step-liked guiding portion facing the metal elastic arms 211 for preventing the metal elastic arms 211 from being surrendered when the elastic arms mated. The metal elastic arms 211 mates with the clamping portion 113 of the mating tongue plate 11 for providing a retaining force to keep the stability between the plug connector 1 and the socket connector 2 when they are jointed.

The second contacts 23 are arranged in two rows and received in the upper and lower wall respectively, and each of them defines a contact portion 230 protruding into the cavity 220. The metal elastic arms 211 defines an interference portion 212 for interfering with the clamping portion 113, and in the inserting direction of the plug connector 1, the interference portion 212 locates ahead of the contact portions 230 of the second contacts 23. When the plug connector 1 is being inserted into the socket connector 2, the interference portion 212 of the metal elastic arm 211 contacts the mating tongue plate 11 first, and after that, the contact portions 230 of the second contacts 23 start to interfere with the mating tongue plate 11, and by which the force a user need in the insertion would be reduced. That is to say, it would be more convenience for using.

What is different from defining clamping portion in the side surface of the mating tongue plate 11, the present aspect of the invention defines clamping portion 113 in the upper and lower surface of the mating tongue plate 11, not only changes the number of the clamping portions from one pair to two pair for a better retaining force, but also when the mating tongue plate becomes miniature and flattening, it could guarantee an enough interference area between the metal elastic arm 211 and the clamping portion 113 to keep the stability between two mated plug connector 1 and socket connector 2. On the other hand, the interference points of the second contacts 2 of the socket connector 2 with the mating tongue 11 and another set of the interference points of the metal elastic arms 211 with the mating tongue 11 is nonlinear, and which prevents the mating tongue plate 11 shaking in the cavity of the socket connector 2. It is noted that in this embodiment the insulative housing 16 forms a plurality of openings (not labeled) in which the contact portion 121 is received. Similarly, the insulative housing 22 forms a plurality of openings (not labeled) in which the contact portion 230 is moveably received. Understandably, an outward deflection of the contact portion 230 should not result in any portion of the contact portion 230 reaching an exterior surface of the housing 22 because it will bring about shorting between the contact portion 230 and the shell which intimately surrounds the housing 22. Anyhow, an insulative tape may be optionally applied upon an exterior surface of the housing 22 to cover those opening for preventing risks of shorting between the contact portion 230 and the shell 21.

In brief, the invention is to provide the plug connector with a mating tongue having a contact region and a pair of retention regions at two ends in the transverse direction wherein in each retention region a pair of clamping portions 113 are formed on two opposite surfaces in the vertical direction, and the receptacle connector with corresponding pairs of elastic arms 211 of the metallic shell 21 extending through the corresponding slots in the housing and into the mating cavity 220 formed in the housing of the receptacle connector. The elastic arm 211 is deflected in the vertical direction same with the deflection direction of the contacts of the receptacle connector which are disposed in the housing of the receptacle connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly comprising a plug connector includes:

a base;

a mating tongue plate being panel-liked and protruding forwardly from the base, and the mating tongue plate defining two opposite surface in an up and down direction, said mating tongue plate including at least a contact carrier defined at one of side opposite surfaces and two side portions at two lateral sides of the contact carrier in a cross direction perpendicular to said up and down direction; and a plurality of contacts including at least one row of contact portions arranged in the contact carrier along the cross direction;

wherein each of the side portions defines at least a clamping portion recessed from the surface thereof; a socket connector comprising an insulative housing with a cavity for receiving the said mating tongue plate; the socket further comprising a metal shell covering the insulative housing and the metal shell defines two pairs of elastic arms at opposite thereof to latch into the respective clamping portions of the mating tongue plate; and the insulative housing defines two pairs of channels at opposite sides thereof for the metal elastic arms passing through.

2. The connector assembly as claimed in claim 1, wherein the clamping portions locate behind the contact portions in an insertion direction of the plug connector perpendicular to both said up and down direction and cross direction.

3. The connector assembly as claimed in claim 1, wherein the mating tongue plate defines two contact carriers defined at said two opposite surfaces, and the contacts include two row of contacting portions arranged in both surfaces thereof, each of the side portions defines two clamping portions recessed from two opposite surfaces thereof in the up and down direction.

4. The connector assembly as claimed in claim 1, wherein each of the contact portions are block-shaped and defines a contacting face flush with the surface of the mating tongue plate.

5. The connector assembly as claimed in claim 1, wherein the base includes a vertical main portion and two fixing portions extending backwardly from the vertical main portion, and the contacts define a set of tail portions extending out of the base, and the tail portions are arranged between the two fixing portions.

6. The connector assembly as claimed in claim 1, wherein said side portions are formed on a metal frame, and said contact carrier is formed on an insulator and separated by the metal frame into two pieces.

7. An electrical connector assembly includes:

a plug connector including a base, a mating tongue plate protruding forwardly from the base, the mating tongue plate defining two opposite insulating contact carriers at opposite sides thereof in an up and down direction and two metal side portions located at two lateral sides of the contact carriers in a cross direction perpendicular to the up and down direction; and a plurality of contacts including contact portions exposed onto the two contact carriers;

and a socket connector for mating with the plug connector and including an insulative housing with a cavity for receiving the said mating tongue plate;

a metal shell covering the insulative housing;

a plurality of second contacts retained in the insulative housing and protruding into the cavity for engaging with the contacts of the plug connector;

wherein each of the side portions defines at least a pair of clamping portions recessed from opposite surfaces thereof in the up and down direction, and the metal shell defines two pairs of elastic arms at opposite thereof and protruding into the cavity to latch into the respective clamping portions of the mating tongue plate; and wherein the insulative housing defines two pairs of channels at opposite sides thereof for the metal elastic arms passing through.

8. The electrical connector assembly as claimed in claim 7, wherein the clamping portions locate behind the contact portions in an insertion direction of the plug connector perpendicular to both said up and down direction and cross direction.

9. The electrical connector assembly as claimed in claim 8, wherein the second contacts defines second contact portions for communicating with the contacts of the plug connector, and the elastic arm also defines an interference portion interfering with the clamping portions which is ahead of the second contact portions in the insertion direction of the plug connector.

10. The electrical connector assembly as claimed in claim 7, wherein each side portion defines at least a guiding incline at one of the opposite sides thereof, and the cavity of the socket connector defines a pair of guiding incline walls for engaging with said guiding inclines.

11. An electrical connector assembly comprising:

a plug connector having a mating tongue extending forwardly from a base along a front-to-back direction, said mating tongue including a contact region and a pair of retention regions at two opposite ends of said contact region in a transverse direction perpendicular to said front-to-back direction;

a plurality of plug contacts with fixed flat contacting sections exposed upon the contact region;

a receptacle connector having an insulative receptacle housing intimately enclosed in a metallic shell and defining a mating cavity therein;

a plurality of receptacle contacts with deflectable curved contacting sections extending into the mating cavity;

a pair of elastic arms unitarily extending from the shell, through the receptacle housing and into the mating cavity; wherein during mating, the mating tongue extends into the mating cavity, the deflectable curved contacting sections mechanically and electrically connected with the corresponding fixed flat contacting sections of the plug contacts, respectively, the pair of elastic arms latches the corresponding retention regions, respectively; and wherein the housing defines a pair of slots through which said pair of elastic arms extend.

12. The electrical connector assembly as claimed in claim 11, wherein the mating tongue extends in the front-to-back direction with a first distance while the fixed flat contacting section of each plug contact is exposed on an exterior surface of the mating tongue with a second distance smaller than the first distance.

13. The electrical connector assembly as claimed in claim 11, wherein said elastic arm is deflected in a vertical direction perpendicular to both said front-to-back direction and said transverse direction.

14. The electrical connector assembly as claimed in claim 13, wherein said deflectable curved contacting sections of the receptacle contact is deflected in the vertical direction.

15. The electrical connector assembly as claimed in claim 11, wherein the plug connector has an insulative plug housing with a plurality of openings to receive corresponding fixed flat contacting sections of the plug contacts, respectively, and the fixed flat contacting sections extend at least coplanar with an exterior surface of the mating tongue; while the receptacle housing formed a plurality of openings into which the deflectable curved contacting sections of the receptacle connector extends, and said deflectable curved contacting sections extend not to reach an exterior surface of the receptacle housing for not shoring with the metallic shell.

16. The electrical connector assembly as claimed in claim 11, wherein each retention region forms a corresponding clamping portion recessed from an exterior of the mating tongue in a vertical direction perpendicular to both said front-to-back direction and said transverse direction.

* * * * *